US006216359B1

(12) United States Patent
Peet

(10) Patent No.: US 6,216,359 B1
(45) Date of Patent: Apr. 17, 2001

(54) GAS FIRED GARMENT DRYER

(75) Inventor: Gene W. Peet, St. Maries, ID (US)

(73) Assignee: Peet Shoe Dryer, Inc., St. Maries, ID (US)

( * ) Notice: Subject to any disclaimer, the term of this patent is extended or adjusted under 35 U.S.C. 154(b) by 0 days.

(21) Appl. No.: 09/483,061

(22) Filed: Jan. 14, 2000

(51) Int. Cl.[7] ..... F26B 25/00

(52) U.S. Cl. ..... 34/105; 34/106; 34/202; 34/234

(58) Field of Search ..... 34/90, 91, 104, 34/105, 106, 220, 234, 232, 233, 103, 201, 202

(56) References Cited

U.S. PATENT DOCUMENTS

| | | | | |
|---|---|---|---|---|
| D. 310,742 | | 9/1990 | Johnson . | |
| D. 347,094 | | 5/1994 | Christensen, Jr. . | |
| D. 350,633 | | 9/1994 | Wong . | |
| D. 412,381 | | 7/1999 | Peet . | |
| 1,281,927 | | 10/1918 | Felton . | |
| 1,543,829 | | 6/1925 | Doyle . | |
| 1,568,078 | | 1/1926 | Mabey . | |
| 1,569,283 | | 1/1926 | Johnson . | |
| 1,637,488 | * | 8/1927 | Knopp | 34/90 |
| 2,076,735 | | 4/1937 | Leindorf . | |
| 3,154,392 | * | 10/1964 | Littman | 34/104 |
| 3,360,871 | * | 1/1968 | Wattenford | 34/90 |
| 3,417,482 | | 12/1968 | Peet . | |
| 3,477,622 | | 11/1969 | Appelt . | |
| 3,645,009 | | 2/1972 | Ketchum . | |
| 3,805,405 | | 4/1974 | Ambos . | |
| 4,085,519 | | 4/1978 | Masika . | |
| 4,094,074 | * | 6/1978 | Schrader et al. | 34/33 |
| 4,200,993 | * | 5/1980 | Blanc et al. | 34/104 |
| 4,209,913 | | 7/1980 | Wallin et al. . | |
| 4,473,060 | * | 9/1984 | Bangerter | 34/90 |
| 4,596,078 | | 6/1986 | McCartney . | |
| 4,689,897 | | 9/1987 | Marsalona . | |
| 4,768,293 | * | 9/1988 | Kaffka | 34/104 |
| 5,014,679 | * | 5/1991 | Childs et al. | 126/21 A |
| 5,115,580 | | 5/1992 | Blumenfeld et al. . | |
| 5,117,565 | | 6/1992 | Willenbacher, Jr. . | |
| 5,125,169 | | 6/1992 | Bader . | |
| 5,412,928 | * | 5/1995 | Reithel | 34/104 |
| 5,570,515 | * | 11/1996 | Schulte | 34/104 |
| 5,604,993 | | 2/1997 | Auckerman . | |
| 5,632,099 | | 5/1997 | Seifert et al. . | |
| 5,797,197 | * | 8/1998 | Alday | 34/90 |
| 5,829,160 | * | 11/1998 | Lange | 34/233 |
| 5,842,285 | * | 12/1998 | van der Veen | 34/108 |
| 5,894,680 | * | 4/1999 | Dalvy et al. | 34/104 |
| 5,930,915 | * | 8/1999 | Dhaemers | 34/233 |
| 6,085,436 | * | 7/2000 | Peet | 34/90 |

OTHER PUBLICATIONS

Photographs of a foot piece for shoe dryers on sale prior to Aug. 31, 1997.

* cited by examiner

*Primary Examiner*—Pamela Wilson
(74) *Attorney, Agent, or Firm*—Wells, St. John, Roberts, Gregory & Matkin, P.S.

(57) ABSTRACT

A gas fired garment drier is described in which a base is provided with an air conduit including an internal air passageway leading from a bottom end to a top end. A gas burner is positioned adjacent the bottom end of the conduit. A heat exchanger is situated adjacent the gas burner and leads into the air conduit and the air passageway. The heat exchanger includes a convection air duct extending into the air conduit within the air passageway. A garment support is provided adjacent the top end of the air conduit.

19 Claims, 6 Drawing Sheets

GAS FIRED GARMENT DRYER

TECHNICAL FIELD

The present invention relates to drying garments and more particularly to gas fired driers for garments such as shoes, boots and gloves.

BACKGROUND OF THE INVENTION

Various apparatus have been developed for drying wet garments, especially footwear and gloves. One such device is disclosed in U.S. Pat. No. 3,417,482 granted on Dec. 24, 1968 to the present inventor, Gene W. Peet. This device has been popular, especially with those who work outdoors in adverse weather. The drier makes use of electric resistance heating elements and thermo-convection induced air movement for even, uniform drying of boots, shoes and gloves. However, dependency on availability of electrical current impedes use of the driers. Those who must camp outdoors or stay for extended periods in areas without the benefit of a generator or other source of electrical current must often simply tolerate wet footwear. Efforts to dry a wet pair of leather boots by placing them next to a campfire often result in ruined boots. This is so since it is well known that boots and shoes should be dried from the inside out, and that overheating can damage the garments.

Thus, while drying efficiency is good especially in those driers using simple warm air convection currents (as provided by the boot and shoe drier cited above), a need has remained for a drier that will operate where no electrical current is available.

An object of the present invention is therefore to provide a garment drier that does not require connection to electrical current for effective operation.

A further object is to provide such a drier that makes use of convection air currents for drying purposes.

A still further object is to provide such a drier that may be used with a conventional combustible gas such as propane that is readily available in pressurized tanks.

The above and still further objects and advantages will become apparent from the following description which, taken with the appended drawings and claims, describe the best mode for carrying out the invention.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Figure 1:
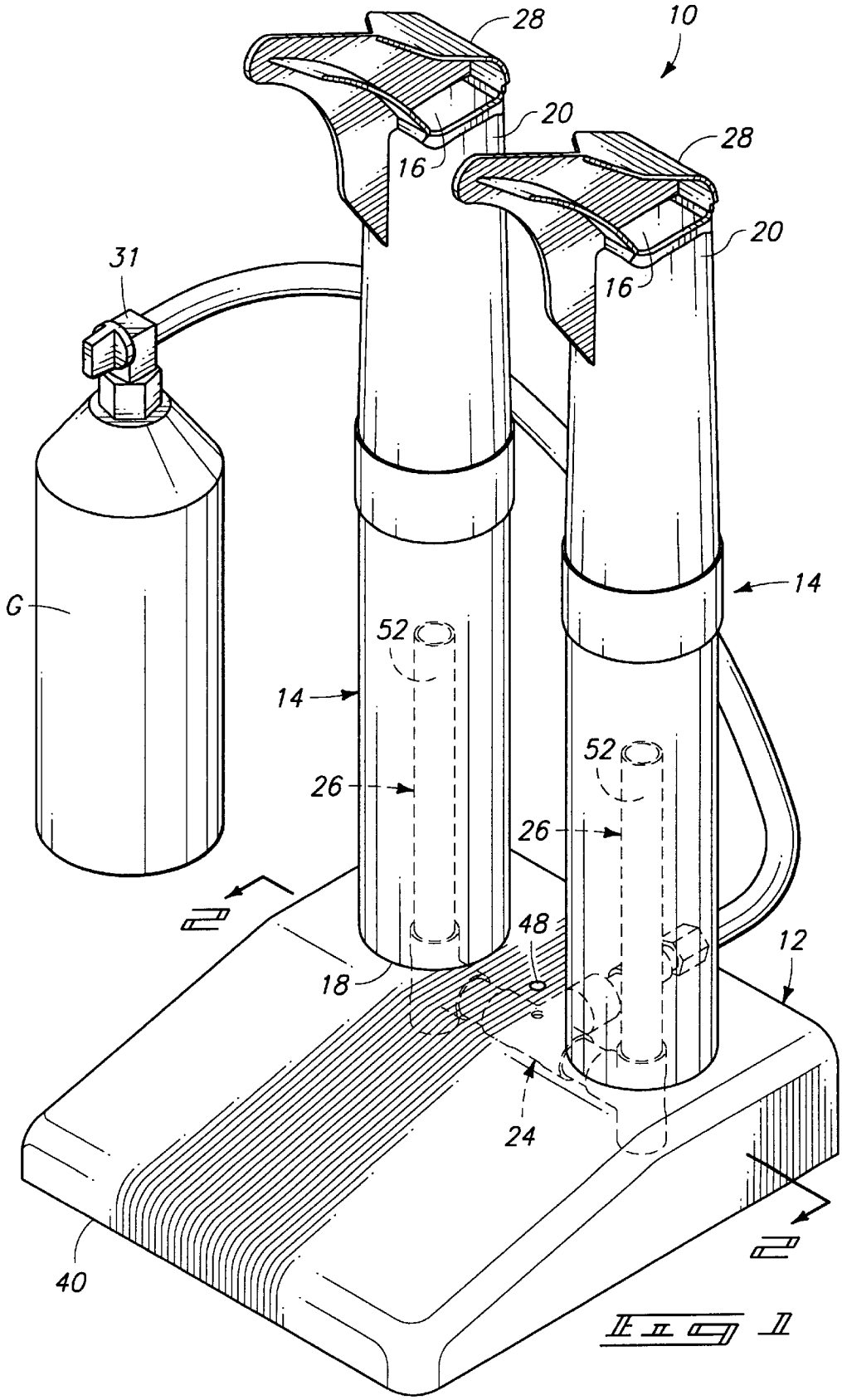
FIG. 1 is a perspective view of a gas fired garment drier exemplifying a preferred form of the invention.

This disclosure of the invention is submitted in furtherance of the constitutional purposes of the U.S. Patent Laws "to promote the progress of science and useful arts" (Article 1, Section 8).

General aspects of the present gas fired garment drier will be given below, with reference to the appended drawings. Further detailed discussion will then follow.

In a first aspect, a gas fired garment drier 10 is generally comprised of a base 12 with an air conduit 14 on the base 12 including an internal air passageway 16 leading from a bottom end 18 to a top end 20. A gas burner 22 is positioned adjacent the bottom end 18. A heat exchanger 24 is situated adjacent the gas burner 22 and leads into the air conduit 14 and the air passageway 16. The heat exchanger 24 includes a convection air duct 26 that extends into the air conduit 14 within the air passageway 16. A garment support 28 is provided on the air conduit 14 adjacent the top end 20.

In another aspect, the drier 10 generally includes a hollow base 12 with a substantially upright air conduit 14 having an open bottom end 18 mounted to and opening into the hollow base 12 and including an internal air passageway 16 leading to an open top end 20. A gas burner 22 is mounted within the base. A heat exchanger 24 is also mounted within the base adjacent the gas burner. The heat exchanger 24 includes a convection air duct 26 extending into the air conduit 14 within the air passageway 16. A garment support 28 is provided on the air conduit 14 adjacent the open top end 20.

Another aspect of the present drier 10 generally includes a base 12 and a pair of elongated substantially upright air conduits 14 mounted to the base 12, each including an internal air passageway 16 leading to a top end 20. A gas burner 22 is mounted to the base 12 and includes a burner tip 30. A gas valve and pressure regulator 31 is connected to the gas burner and configured to be fitted to a source of pressurized combustible gas G. A heat exchanger 24 is situated adjacent the gas burner and includes a heat collector plenum 32 enclosing the burner tip 30. The heat collector plenum 32 includes branch tubes 33 that lead toward the upright air conduits 14. Convection air ducts 26 are connected to the branch tubes 33 and extend into the air conduits 14 within the air passageways 16. The convection air ducts 26 include open bottom and top ends 34, 36. The open bottom ends 34 are situated adjacent respective bottom ends 18 of the air conduits. The branch tubes 33 open into respective convection air ducts 26 at points 38 between the open bottom ends 34 and the open top ends 36 of the convection air ducts 26. Garment supports 28 are situated adjacent the top ends 20 of the air conduits 14.

Figure 2:
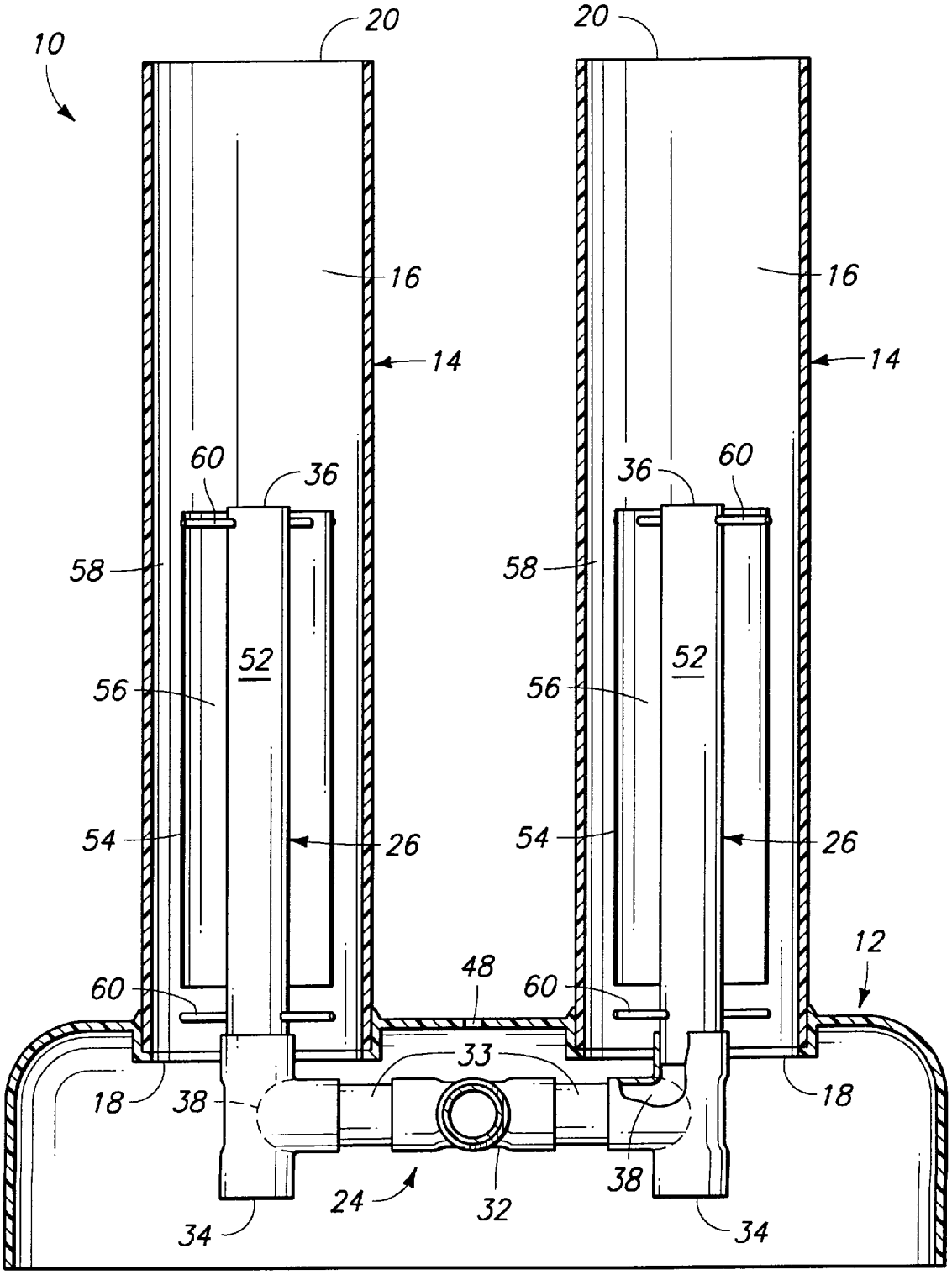
FIG. 2 is a sectional view taken along line 2—2 in FIG. 1.
Figure 3:
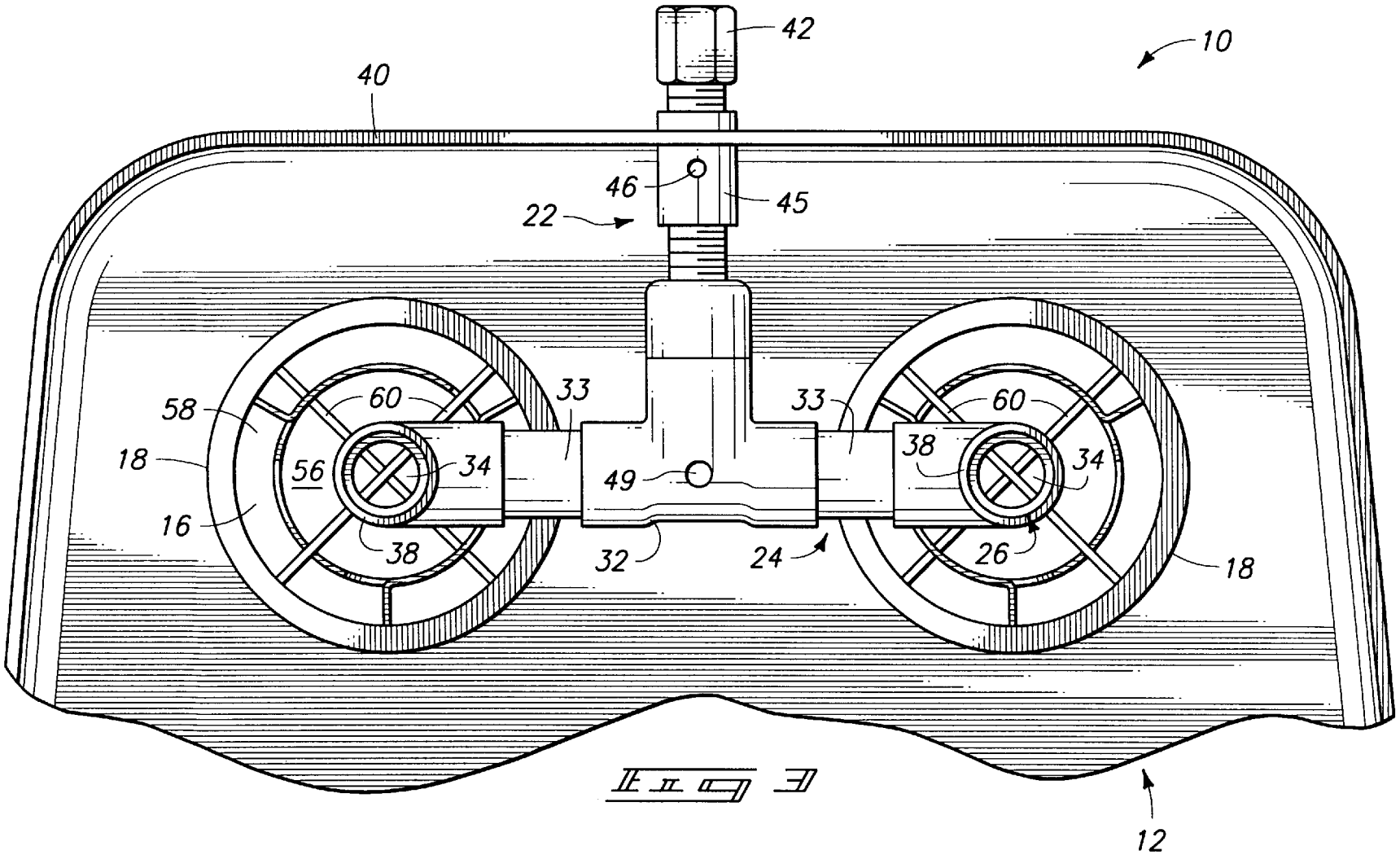
FIG. 3 is a fragmented enlarged bottom plan view.
Figure 4:
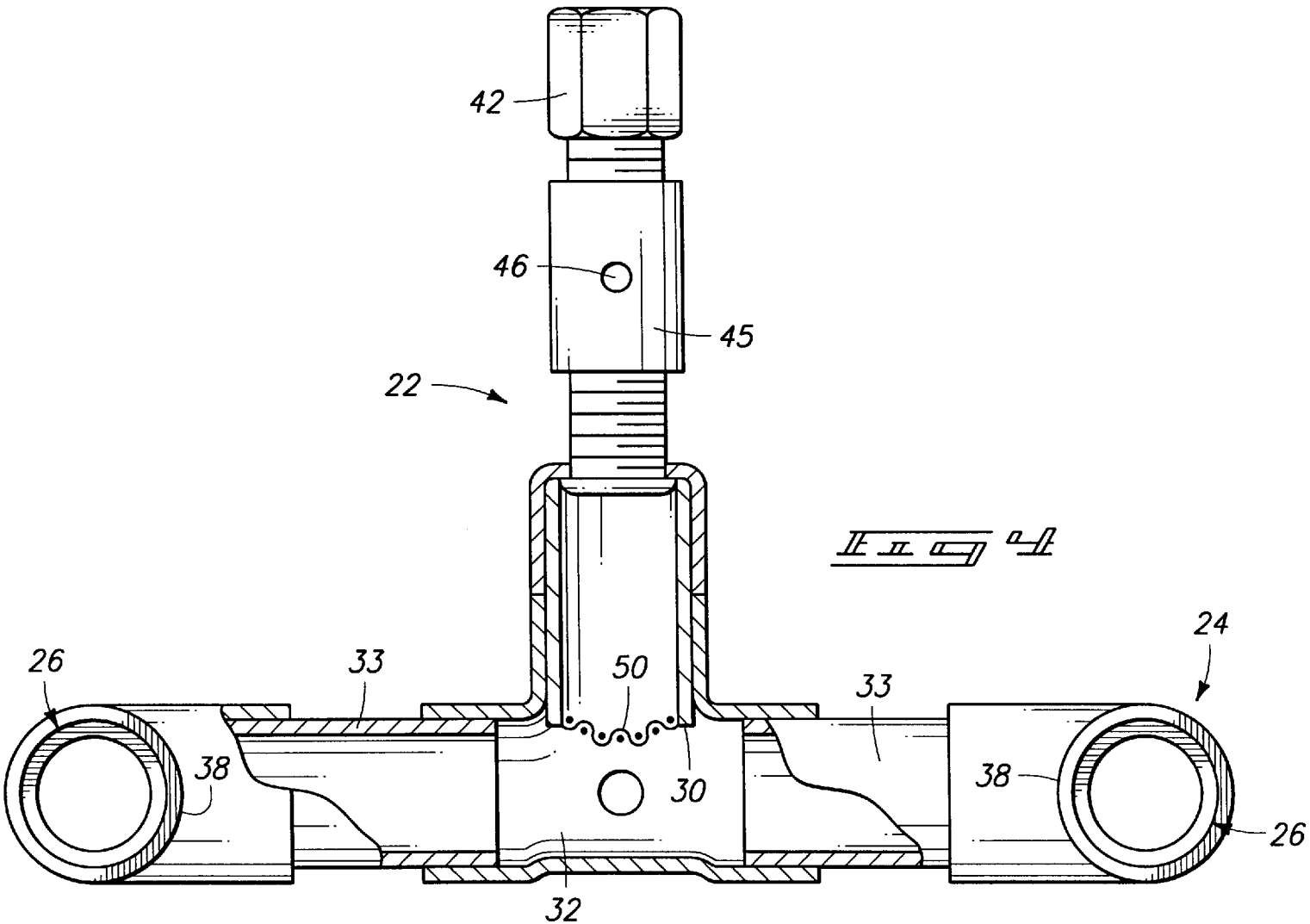
FIG. 4 is an enlarged partially fragmented view of the gas burner and heat exchanger.

Referring now to specific preferred constructions of components in preferred forms of the present drier 10, reference is first made to FIGS. 1–3. There, a preferred example of the base 12 is shown. The preferred base is constructed of molded plastic in a hollow configuration. A bottom surface 40 of the base 12 is generally planar to support the base on any appropriate substantially flat support surface. In the illustrated example, sufficient space is provided within the base above the bottom surface 40 to receive the burner and heat exchanger components.

It is preferred, as illustrated in the drawings, that two air conduits 14 be mounted on the base 12. The air conduits are most preferably generally upright to facilitate air movement by way of thermo-convection induction (the tendancy for warm air to raise) and may vary in height, depending upon the garment to be dried. High top boots, for example may require long air conduits 14. Gloves and shoes may be dried using shorter conduits. To accommodate such variations, the conduits may be provided in separable sections.

In preferred forms, the air conduits are 14 are open at the bottom ends 18 and top ends 20 as well. They may be formed of the same plastic material as the base, and be affixed or releasably mounted thereto. The conduits 14 may be circular in cross section as shown, or other configurations could be used without departing from the scope of the invention.

The top ends 20 of the air conduits are provided with garment supports 28 (FIG. 1) that may be configured to accommodate a particular garment. In the illustrated example, the supports 28 are configured to support and direct heated convection air into boots or shoes. Gloves may also be placed over the illustrated supports. Alternatively, other supports may be provided that are particularly adapted to aid air flow through gloves or mittens. For such alternative uses, it is preferred that the supports 28 be removable or formed on removable sections of the air conduits 14 to facilitate interchanging various forms of garment supports. It is also possible that the top conduit ends 20 could be used alone as the garment supports 28.

FIG. 1 illustrates a conventional gas bottle or canister G that is attached to the gas burner 22 by way of a valve and burner regulator 31, and a conventional gas delivery hose. It is preferred that the combustible gas be of a conventional, readily available type such as propane that is commonly used for heat and lighting. The valve and pressure regulator may also be of a conventional form, pre-set to release gas at a low pressure (within a range of approximately 0.5 to 5 psi and most preferably at approximately 0.6 psi). Propane, released through the present burner at 0.6 psi will produce approximately 500 btu. in preferred forms of the drier 10.

Gas enters the burner 22 through a conventional gas fitting 42 (FIGS. 5, 6) that leads to a nozzle 43. The nozzle 43 may be formed of brass or other appropriate metal or ceramic and include a discharge opening 44 that is provided according to the type of gas and pressure being used. Propane, delivered at approximately 0.6 psi may best be used with a discharge opening of approximately 0.007 inches.

An air and gas mixing housing 45 may be provided to enclose the nozzle 43. The housing 45 may be formed of a metal tube that, as shown, may be threaded onto the nozzle. Air and combustible gas mix within the housing through provision of air bleed holes 46. Several of the bleed holes may be provided at substantially equally spaced angles about the housing to introduce air into the mixing housing 45. In one working example, 4 holes were formed through the housing, each hole having a diameter of approximately 0.17 inches. Air is drawn into the mixing chamber by a venturi effect from the pressurized gas discharged through the nozzle.

Figures 5, 6:
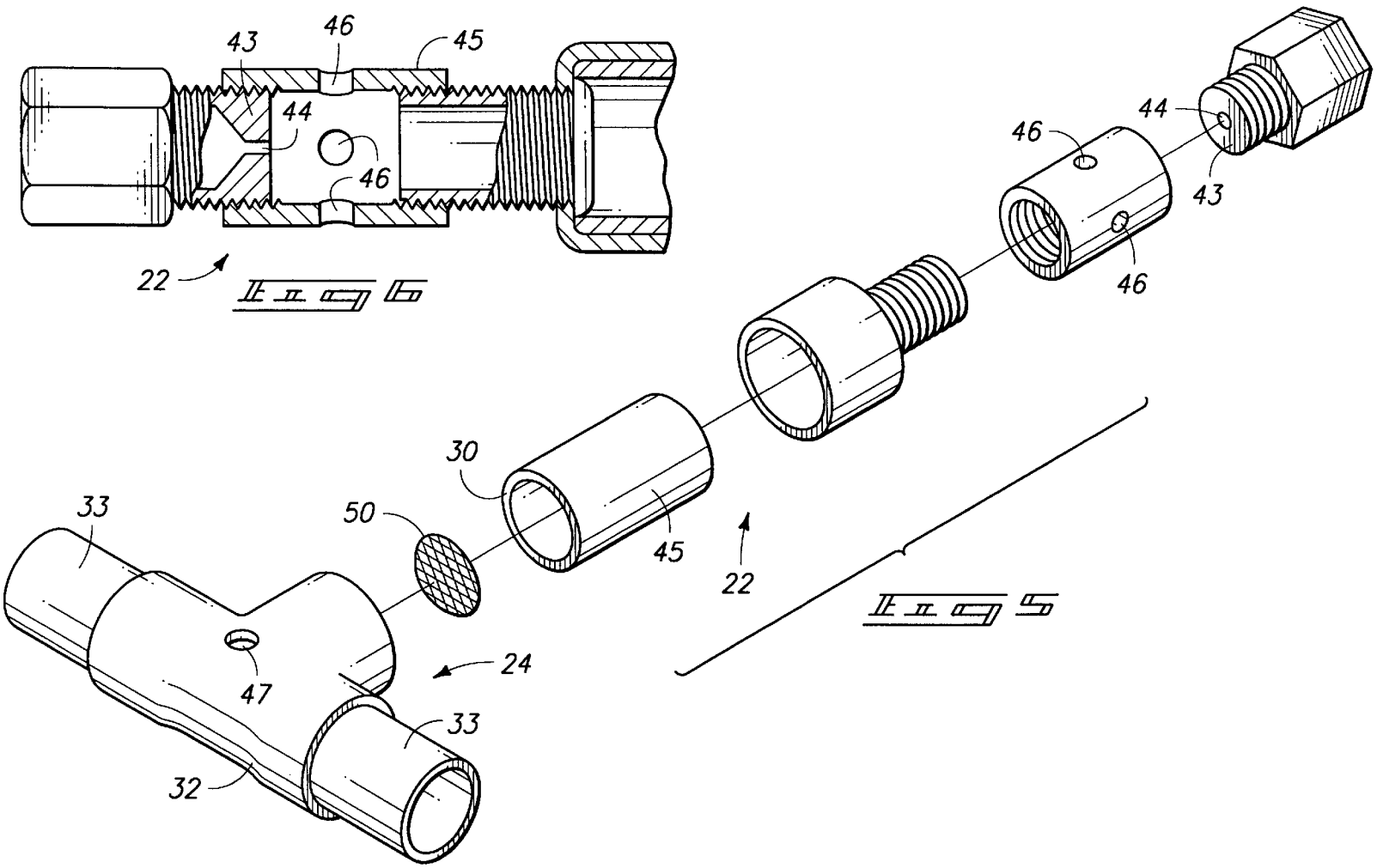
FIG. 5 is an exploded perspective view of the gas burner and a fragmented part of the heat exchanger.
FIG. 6 is a partially sectioned view of the gas burner.

The burner tip 30 is situated downstream of the mixing chamber, adjacent the heat exchanger 24. The tip may be formed of a metal tube, and be mounted to the mixing housing as illustrated in FIG. 6. A flame diffuser 50 is preferably included in the gas burner adjacent to and more preferably within the burner tip 30. The preferred flame diffuser 50 is comprised of a heat resistant open mesh screen that spans the burner tip. The diffuser has the effect of stabilizing the gas flame, forming somewhat of a "bubble" shape at the discharge end of the tip.

The heat exchanger 24, in preferred forms is formed by a heat conductive tube, preferably of a heat conductive material such as aluminum. The preferred heat exchanger includes the heat collector plenum 32 which encloses the gas burner, and more particularly the burner tip 30 at its outward end. The plenum 32 is inwardly open, to form a chamber about the flame when the unit is operating. The interior walls of the plenum are formed so the flame does not impinge on any surface and thereby discourages spot heating of the collector surfaces.

In the illustrated preferred example, the plenum 32 is comprised of a "T" that may be produced by a copper plumbing fitting. The leg of the "T" fits over the burner tip 30. The cross part of the "T" mounts the branch tubes 33, which may be formed of copper tube that is soldered, welded, or otherwise affixed to the plenum 32. Each of the branch tubes 33 includes an open internal bore leading substantially horizontally toward an associated air conduit 14 and convection air duct 26.

The heat exchanger preferably includes a flame view port 47 formed therein adjacent the burner. A flame will be visible through the port when the unit is operating and the user can easily see when ignition takes place when the unit is fired. To this end, the base 12 (FIGS. 1,2) preferably includes a flame viewing aperture 48 that is substantially aligned with flame view port 47 to facilitate visual monitoring of the flame while the unit is resting on a support surface.

Figure 7:
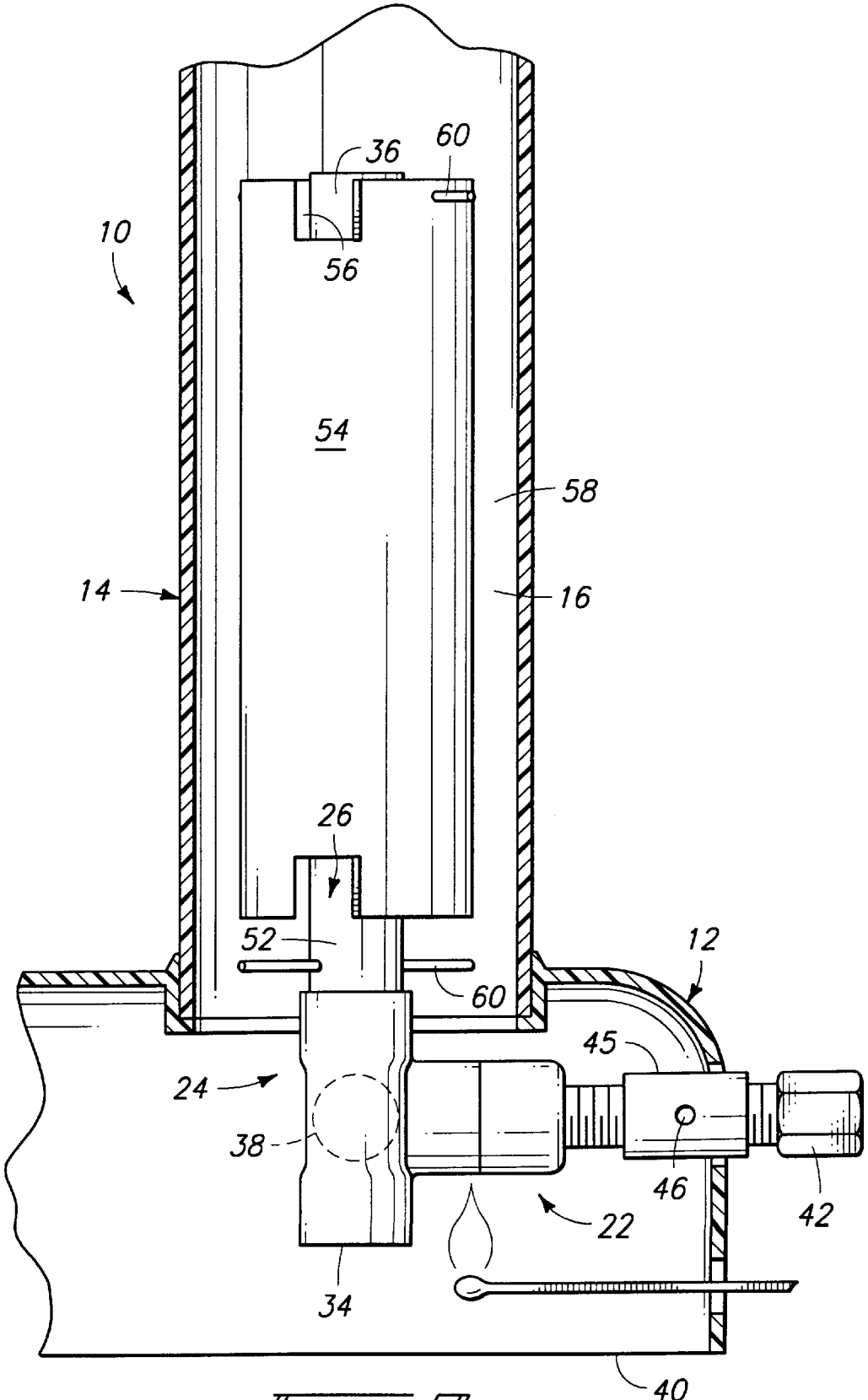
FIG. 7 is a fragmented sectional view of an air conduit and the heat exchanger.

It is noted that gasses in the burner may be ignited as graphically indicated in FIG. 7, through an ignition touch hole 49 (FIG. 3) formed on the bottom side of the heat exchanger just downstream of the burner tip. Other forms of ignition may be used, and other locations may be provided for ignition purposes. For example, it is entirely feasible to ignite the gasses through the view port 47.

The branch tubes 33 are provided to conduct the heated exhaust gasses from the flame at the burner tip 30 into the convection air ducts 26. The exhaust gasses enter the convection air ducts 26 at points 38 that are above the air duct bottom ends 34, and below the air duct top ends 36. The gasses, being warmer than the surrounding air, will naturally move upwardly, producing a convection air flow upwardly within the ducts, along with air pulled into the ducts through the open duct bottom ends 34. The spent gasses mix with the fresh air inside the ducts 26, heating the air and moving upwardly in a thermo-convection induced airflow to be discharged through the open top ends of the conduits 14.

Referring in greater detail to preferred forms of the convection air ducts 26, attention is drawn to FIG. 2 of the drawings. The air ducts may be considered as part of the heat exchanger. Each duct 26 includes an elongated portion 52 that is substantially centered within the associated air conduit 14. The ducts 26 are also preferably formed of heat conductive tubes such as copper tubing and may be fitted to the branch tubes by "T" fittings which define the open entry points 38, and the open bottom ends 34 of the ducts.

In preferred forms, the ducts 26 may be within a range of approximately 4 inches to 9 inches in length. The greater parts of the duct lengths are situated within the conduits 14 to best initiate upward air current. Thus the open top ends 36 of the ducts 26 positioned upwardly within the conduits but below the open top ends 20 of the associated conduits 14 to allow upward passage and mixing of warmed air currents.

The open bottom ends 34 of the ducts are preferably situated below the burner 22 and somewhat below the open bottom ends of the conduits 14. This arrangement encourages intake of the lowest temperature air (within the base) through the bottom duct ends, while somewhat warmer air is free to enter the space between the ducts 26 and interior walls of the conduits 14 through the slightly upwardly spaced bottom conduit ends 18.

As exemplified in FIGS. 2, 3, and 5, convection ducts 26 are preferably centered within the associated conduits 14 and within elongated open ended heat shields 54. The heat shields may be formed of an appropriate heat metal such as aluminum with inward reflective surfaces at least partially encircling the elongated portions of the heat conductive duct tubes within the air conduits. The heat shields form elongated axial internal air spaces 56 (FIGS. 2, 3) between the heat conductive tube and external air spaces 58 between the heat shield and air conduit. The heat shields are useful to protect the conduits 14 from any potential excessive heat, and function well to channel warmed air upwardly within the conduits and out the open top ends 20.

Positioning wires or rods 60 may be provided to extend through the heat shields 54 and convection air ducts to engage side walls of the conduits 14 and hold the shields 54 and ducts 26 in substantial concentric relation. The rods 60 may be flexible to hold the shields and convection air ducts longitudinally in position by spring action against the conduit walls.

In operation, the user may first place garments, for example a pair of boots over the supports 28. Most preferably, the boots are placed upside down (with soles facing upwardly) over the supports, such that the supports are received inside the boots.

The user may attach the valve and pressure regulator to a pressurized gas bottle or canister G as shown in FIG. 1. The attachment between the gas bottle and burner is now completed.

Next, the user may open the valve 31 to allow pressurized gas to flow from the canister G, through the nozzle 43 and into the gas and air mixing housing 45. Air will enter by venturi action through the bleed holes 46 to mix with the gas. The mix will then pass through the burner tip. This combustible mixture may be ignited.

Ignition may be accomplished using a match or other appropriate igniter, placed next to the touch hole 49. A small "bubble" of flame will become visible through the view port 47 and the viewing aperture 48 once proper ignition has taken place. The diffuser 50 will function through ignition and as combustion continues, to diffuse the gas and air mix across the burner tip and aid to produce a small but stable flame.

It is preferred that the small flame not impinge against the adjacent interior surfaces of the plenum in order to avoid overheating of the heat exchanger 24. However, the flame will warm the air within the plenum 32 and heat will also transfer by conduction through the heat exchanger, to the branch tubes and convection air ducts 26.

The heated, spent gasses will travel along the branch tubes 33 and enter the convection air ducts 26 at the opening points 38, just above the open bottom duct ends 34, then travel upwardly due to the natural tendency for heated air to raise. Upward movement of the heated air inside the ducts 26 causes unheated air to be drawn into the open bottom duct ends 34 from the environment within the base 12. This air mixes with incoming exhaust gasses and is also heated by the walls of the ducts, and will therefore also raise upwardly in the ducts. Continuous upward warm dry air movement is thus produced so long as the flame continues to burn.

The heated air and spent gasses exit through the top open ends of the ducts 26 in a positive air flow that will continue moving upwardly and be discharged through the open top ends of the conduits 14, entering the boots and effecting drying action by evaporation created by warm air movement against the adjacent internal surfaces of the boots. The air cooled by evaporation will drop down outside the conduits 14 and exit from below the boot top. Thus a constant drying airflow is produced until either the boots are removed or the valve 31 is turned off.

The ducts 26 are also heated by conduction from the collector plenum 32. The warmed upright ducts, also warm the air along the internal air spaces 56, thus inducing further upward air flow. Cooler replacement air is naturally drawn into the air spaces 56 through the bottom ends of the conduits 14, to replace the heated air which moves upwardly through the internal air spaces 56 and into the boots through the top ends of the conduits. The same process occurs in the external air spaces 58 between the heat shields 54 and inner walls of the conduits, only the air within the external spaces 58 will be substantially cooler than the air passing through the internal air spaces 56 and inside the convection air ducts 26. Still, the air in the external spaces 58 will also raise by convection and pass through the boots to assist in the drying effort.

Once the boots are dry, the valve 31 may be turned to an off position, blocking flow of gas to the burner. The flame will thus be extinguished and the dry, warm boots may be removed for use.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A gas fired garment drier, comprising:

a base;

an air conduit on the base including an internal air passageway leading from a bottom end to a top end;

a gas burner positioned adjacent the bottom end;

a heat exchanger adjacent the gas burner and leading into the air conduit and the air passageway;

wherein the heat exchanger includes a convection air duct formed by a heat conductive tube extending into the air conduit within the air passageway; and a garment support on the air conduit adjacent the top end.

2. The drier of claim 1 wherein the gas burner is situated within the base.

3. The drier of claim 1 wherein the heat conductive tube includes an elongated portion substantially centered within the air conduit; and an elongated open ended heat shield at least partially encircling the elongated portion of the heat conductive tube within the air conduit and forming an internal air space between the heat conductive tube and an external air space between the heat shield and air conduit.

4. The drier of claim 1 wherein the gas burner is comprised of:

a gas fitting mounted to the base and leading to a nozzle;

an air and gas mixing housing enclosing the nozzle; and a burner tip positioned adjacent the heat exchanger.

5. The drier of claim 1 wherein the gas burner is comprised of:

a gas fitting leading to a nozzle;

an air and gas mixing housing enclosing the nozzle; and a burner tip on the air and gas mixing housing and positioned within the heat conductive tube.

6. The drier of claim 1 wherein the gas burner is comprised of:

a gas fitting leading to a nozzle;

an air and gas mixing housing enclosing the nozzle and defining a mixing chamber; and the housing having air bleed holes formed therein to admit air into the air and gas mixing housing.

7. The drier of claim 1 wherein the gas burner is comprised of:

a gas fitting leading to a nozzle;

an air and gas mixing housing enclosing the nozzle and defining a mixing chamber;

the air and gas mixing housing having air bleed holes formed therein to admit air into the air and gas mixing chamber;

a burner tip positioned on the housing and adjacent the heat exchanger; and a flame diffuser on the housing adjacent the burner tip.

8. The drier of claim 1 wherein the gas burner is comprised of:

a gas fitting;

a housing connected to the gas fitting;

a burner tip mounted to the housing and positioned adjacent the heat exchanger; and a flame diffuser on the gas burner adjacent the burner tip.

9. The drier of claim 1 wherein the gas burner is comprised of:

a gas fitting;

a housing connected to the gas fitting;

a burner tip mounted to the housing and positioned adjacent the heat exchanger; and a flame diffuser on the gas burner adjacent the burner tip; and wherein the flame diffuser is comprised of a heat resistant open mesh screen.

10. A gas fired garment drier, comprising:

a hollow base;

a substantially upright air conduit having an open bottom end mounted to and opening into the hollow base and including an internal air passageway leading to an open top end;

a gas burner mounted within the base;

a heat exchanger mounted within the base adjacent the gas burner;

wherein the heat exchanger includes a heat conductive convection air duct extending into the air conduit within the air passageway; and a garment support on the air conduit adjacent the open top end.

11. The drier of claim 10 wherein the convection air duct includes an open bottom end adjacent the bottom end of the air conduit and an open top end.

12. The drier of claim 10 wherein the heat exchanger includes a heat collector plenum enclosing the gas burner and a branch tube leading to the convection air duct;

wherein the convection air duct includes an open bottom end adjacent the bottom end of the air conduit and an open top end; and wherein the branch tube opens into the convection air duct at a point between the open bottom end and the open top end.

13. The drier of claim 10 wherein the convection air duct includes an open bottom end adjacent the bottom end of the air conduit and an open top end; and wherein the heat exchanger further includes a branch tube leading from the gas burner and opening into the convection air duct.

14. The drier of claim 10 wherein the convection air duct includes an open bottom end adjacent the bottom end of the air conduit and an open top end; and wherein the heat exchanger further includes a branch tube leading from the gas burner and opening into the convection air duct between the open bottom and top ends thereof.

15. The drier of claim 10 wherein the convection air duct includes an open bottom end adjacent the bottom end of the air conduit and an open top end;

wherein the heat exchanger further includes a branch tube leading from the gas burner and opening into the convection air duct; and wherein the heat exchanger further includes a flame view port formed therein adjacent the burner; and wherein the base includes a flame viewing aperture substantially aligned with the flame view port.

16. The drier of claim 10 wherein the convection air duct includes an open bottom end within the base and extends to an open top end within the air conduit.

17. The drier of claim 10 wherein the heat exchanger and convection air duct are formed of heat conductive metal tubing.

18. The drier of claim 10 further Comprising a heat shield formed around the convection air duct within the air conduit.

19. A gas fired garment drier, comprising:

a base;

a pair of elongated substantially upright air conduits mounted to the base, each including an internal air passageway leading to a top end;

a gas burner mounted to the base and including a burner tip;

a gas valve and pressure regulator connected to the gas burner and configured to be fitted to a source of pressurized combustible gas;

a heat exchanger adjacent the gas burner and including a heat collector plenum enclosing the burner tip;

wherein the heat collector plenum includes branch tubes leading toward the upright air conduits;

convection air ducts connected to the branches and extending into the air conduits within the air passageways;

wherein the convection air ducts include open bottom ends adjacent respective bottom ends of the air conduits and open top ends; and wherein the branch tubes open into respective convection air ducts at a points between the open bottom ends and the open top ends thereof; and garment supports adjacent the top ends of the air conduits.

* * * * *

UNITED STATES PATENT AND TRADEMARK OFFICE

CERTIFICATE OF CORRECTION

PATENT NO. : 6,216,359 B1
DATED : April 17, 2001
INVENTOR(S) : Gene W. Peet

It is certified that error appears in the above-identified patent and that said Letters Patent is hereby corrected as shown below:

Column 8,
Line 32, replace "Comprising" with -- comprising --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*